US007337502B2

(12) United States Patent
Mermelshtein

(10) Patent No.: US 7,337,502 B2
(45) Date of Patent: Mar. 4, 2008

(54) FASTENING SYSTEM

(75) Inventor: Gilad Mermelshtein, Gan Yavne (IL)

(73) Assignee: Interlink Technologies, Inc., Atlanta, GA (US)

( * ) Notice: Subject to any disclaimer, the term of this patent is extended or adjusted under 35 U.S.C. 154(b) by 0 days.

(21) Appl. No.: 11/368,904

(22) Filed: Mar. 6, 2006

(65) Prior Publication Data

US 2007/0084021 A1 Apr. 19, 2007

Related U.S. Application Data

(60) Provisional application No. 60/726,538, filed on Oct. 14, 2005.

(51) Int. Cl.
*B65D 63/00* (2006.01)

(52) U.S. Cl. ..... 24/16 PB; 24/30.5 R; 24/30.5 S; 24/30.5 P; 24/275; 24/19; 70/16; 248/74.3

(58) Field of Classification Search ..... 24/16 PB, 24/268, 270, 275, 19, 19 PB, 30.5 R, 30.5 S; 70/16

See application file for complete search history.

(56) References Cited

U.S. PATENT DOCUMENTS 3,983,603 A * 10/1976 Joyce ..... 24/16 PB
4,077,562 A * 3/1978 Ballin ..... 383/71
4,221,352 A * 9/1980 Caveney ..... 248/74.3
4,223,424 A * 9/1980 Burnett ..... 24/30.5 R
4,272,870 A * 6/1981 McCormick ..... 24/16 PB
4,473,524 A * 9/1984 Paradis ..... 264/291
4,510,649 A * 4/1985 Yudis et al. ..... 24/16 PB
4,866,816 A * 9/1989 Caveney ..... 24/16 PB
5,088,158 A * 2/1992 Burkholder ..... 24/16 PB
5,177,986 A * 1/1993 Jensen ..... 70/18
5,836,053 A * 11/1998 Davignon et al. ..... 24/16 PB
5,956,813 A * 9/1999 Cooper ..... 24/16 PB
6,185,791 B1 * 2/2001 Khokhar ..... 24/16 PB
6,349,904 B1 * 2/2002 Polad ..... 248/74.3
6,364,257 B1 * 4/2002 Holder ..... 248/74.3
6,594,867 B1 * 7/2003 Pettersson ..... 24/16 PB
6,776,789 B2 * 8/2004 Bryant et al. ..... 606/213
6,863,855 B2 * 3/2005 Shilale ..... 264/151
7,017,237 B2 * 3/2006 Magno et al. ..... 24/16 PB

* cited by examiner

*Primary Examiner*—Katherine Mitchell
*Assistant Examiner*—Marcus Menezes
(74) *Attorney, Agent, or Firm*—Needle & Rosenberg., P.C.

(57) ABSTRACT

A fastening system that comprises an elongate strap body having a pair of opposed side portions and a top surface between the side portions. The fastening system also has a plurality of spaced male protrusions extending therefrom the top surface of the elongate strap body a protrusion height. Each protrusion has two faces and a protrusion axis, which is substantially perpendicular to the longitudinal axis. The fastening system comprises the ability to form a slit in the top surface of the strap body at almost any location. The slit may generally extend between the pair of side portions, substantially parallel to the protrusion axis and between adjacent male protrusions. The slit may also have end segments extending substantially parallel to the longitudinal axis of the elongate strap body, forming a "tongue."

32 Claims, 3 Drawing Sheets

FASTENING SYSTEM

CROSS-REFERENCE TO RELATED APPLICATIONS

This application claims priority to and the benefit of U.S. Provisional Application No. 60/726,538, filed Oct. 14, 2005, which is incorporated in its entirety in this document by reference.

FIELD OF THE INVENTION

The present invention relates to a fastening system, more specifically to a fastening system that can be configured to any desired length.

BACKGROUND OF THE INVENTION

Cable fasteners are used to bind cables or other objects and are conventionally made by injection molding thermoplastic materials. Most cable fasteners comprise a strap with a head on one end and a plurality of teeth along the longitudinal axis of the strap. In use, the end of the strap without the head is placed through on opening defined in the head to form a loop. The head generally comprises an engaging surface to engage the teeth of the strap in a ratchet-like relation. Thus, pulling on the end of the strap constricts the loop, while expansion of the loop is restricted by the engagement of the teeth within the head.

Some of the benefits of the state of the art cable fasteners include ease of use and low cost. However, they are limited in use and function because they have, by design, preconstructed and fixed heads. The length of the cable fastener is, therefore, predetermined. Should an end-user need a short cable fastener, he would have to either purchase a fastener to length, or cut a longer fastener, contributing to material waste.

SUMMARY

The present invention relates to a fastening system that comprises an elongate strap body having a pair of opposed side portions and a top surface between the side portions. In one aspect, the fastening system also has a plurality of spaced male protrusions extending therefrom the top surface of the elongate strap body a predetermined height, e.g., the protrusion height. In another aspect, each protrusion has two faces and a protrusion axis that is substantially perpendicular to the longitudinal axis of the strap body.

The fastening system of the present invention can be manufactured to almost any length whatsoever and, in one aspect, further comprises the ability to form a slit in the top surface of the strap body at almost any desired location. In one exemplary aspect, the slit may generally extend between the pair of side portions, substantially parallel to the protrusion axis and between adjacent male protrusions. For another aspect, the slit may also have end segments extending substantially parallel to the longitudinal axis of the elongate strap body, forming a "tongue."

In one aspect, an end portion of the elongate strap body is positionable through the slit to form a loop with the elongate body. In use, constriction of the loop causes a portion of the tongue to slide thereon the respective first faces of the male protrusions proximate the tongue, while expansion of the loop is restricted by engaging a portion of the tongue thereon the second face of a protrusion adjacent the tongue. This action can be likened to the action of a ratchet type wrench.

The preceding description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. The corresponding structures, materials, acts, and equivalents of all means or step plus function elements in the claims below are intended to include any structure, material, or acts for performing the functions in combination with other claimed elements as specifically claimed.

Accordingly, those who work in the art will recognize that many modifications and adaptations to the present invention are possible and can even be desirable in certain circumstances and are a part of the present invention. Other embodiments of the invention will be apparent to those skilled in the art from consideration of the specification and practice of the invention disclosed herein. Thus, the preceding description is provided as illustrative of the principles of the present invention and not in limitation thereof. It is intended that the specification and examples be considered as exemplary only, with a true scope and spirit of the invention being indicated by the following claims.

BRIEF DESCRIPTION OF THE DRAWINGS

The accompanying drawings, which are incorporated in and constitute a part of this specification, illustrate certain aspects of the instant invention and together with the description, serve to explain, without limitation, the principles of the invention. Like reference characters used therein indicate like parts throughout the several drawings.

DETAILED DESCRIPTION OF THE INVENTION

Figure 1:
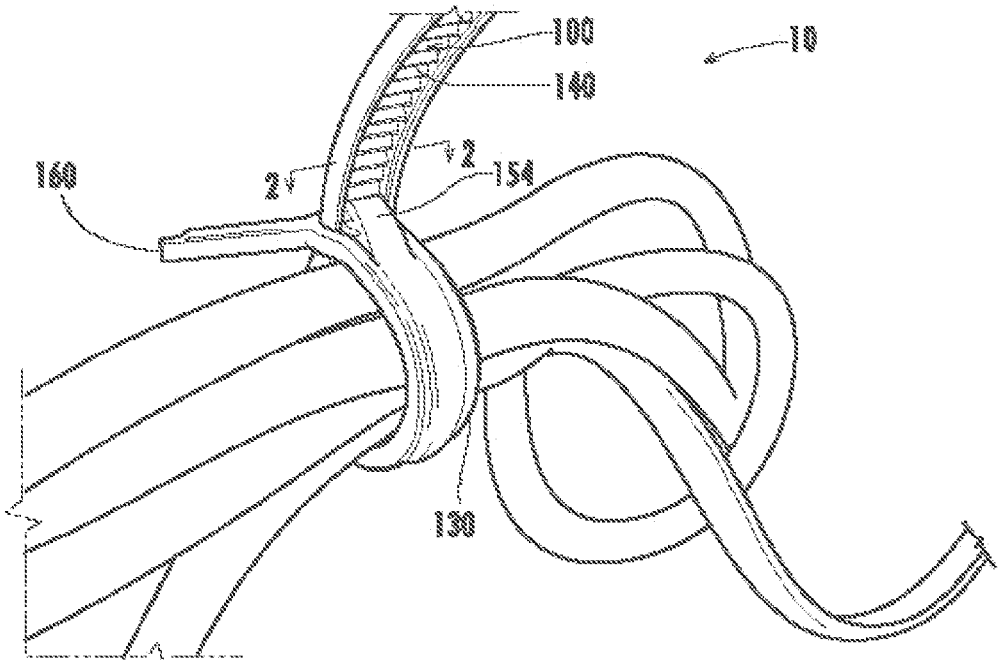
FIG. 1 is a perspective view of one embodiment of the fastening system of the present invention shown in use.

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used herein, the singular forms "a," "an" and "the" include plural referents unless the context clearly dictates otherwise. Thus, for example, reference to a "surface" includes aspects having two or more such surfaces unless the context clearly indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The present invention may be understood more readily by reference to the following detailed description of preferred embodiments of the invention and the examples included therein and to the Figures and their previous and following description.

In one aspect of the present invention for a fastening system 10, the fastening system 10 comprises an elongate strap body 100 having a pair of opposed side portions 110 and a top surface 120 extending therebetween the side portions. In another aspect, the fastening system also comprises a plurality of spaced male protrusions 140 that extend from the top surface 120 a predetermined protrusion height $H_P$. In one exemplary aspect, each protrusion has two opposed faces; a first face 142 and a second face 144. A protrusion axis P is defined, which is, in one example, substantially perpendicular to the longitudinal axis L of the strap body 100.

In one exemplary aspect of the invention, the male protrusions 140 are substantially evenly spaced. In another exemplary aspect, the male protrusions are substantially evenly spaced over the length of the body. In yet another aspect, the protrusion height $H_P$ of each protrusion is substantially equal. In will be appreciated that it is contemplated that the spacing and the height of the male protrusions can vary greatly according to the particular use of the fastening system.

In another aspect, the first face 142 of the plurality of male protrusions extends therefrom the top surface at a predetermined first face angle $\alpha$. In this aspect, the predetermined first face angle $\alpha$ can be from about 120° to about 150°. In another aspect, the predetermined first face angle $\alpha$ can be about 125°, 130°, 135°, 140°, or 145°. However, it is contemplated that a variety of angles for the first face angle would be sufficient.

The second face 144 of the plurality of male protrusions extends therefrom the top surface at a predetermined second face angle $\beta$. In this aspect, the predetermined second face angle $\beta$ can be from about 60° to about 120°. In another aspect, the predetermined second face angle $\beta$ can be about 75°, 80°, 85°, 90°, 95°, 100°, or 105°, although many predetermined second face angles are contemplated.

In another aspect of the invention, the side portions 110 extend upwardly above the top surface of the elongate strap body. They may, for example, extend above the top surface 120 a distance that is greater than the protrusion height of the male protrusions, however, and as one would appreciate, this is not a requirement of the fastening system.

In one aspect, a slit 150 may be formed therein the top surface of the strap body, generally extending between the pair of side portions and substantially parallel to the protrusion axis P of the male protrusions. The slit 150 is formed between adjacent male protrusions 140 substantially anywhere along the length of the elongate strap body 100. In one aspect, the slit is formed such that it also comprises end segments 152 that generally extend substantially parallel to the longitudinal axis L of the strap body 100 such that a tongue 154 is formed, as illustrated in FIG. 1. As one skilled in the art would appreciate, the tongue can have any desired cross-sectional shape. For example and not meant to be limiting, the tongue 154 may be substantially u-shaped or substantially H-shaped.

In another aspect, an end portion 160 of the elongate strap body is positionable through the slit to form a loop with the elongate body. In use, constriction of the loop causes a portion of the tongue to slide thereon the respective first faces 142 of the male protrusions on the end portion of the elongate strap body proximate the tongue, while expansion of the loop is restricted by engaging a portion of the tongue thereon the second face 144 of a protrusion on the end portion of the elongate strap body adjacent the tongue 154. This action can be likened to the action of a ratchet type wrench. In yet another aspect, rather than the end of the tongue engaging the second face of the protrusion on the elongate strap body, the second face of at least one protrusion positioned on the tongue engages the second face of the protrusion on the end portion of the elongate strap body 100. In either case, as with a common cable tie, the action required to expand the loop is very difficult, while the action to constrict the loop is fairly easy (i.e., the force required to expand the loop is larger than the force required to constrict the loop). One of the advantages of the present system over a common cable tie is the ability to form the slit or tongue substantially anywhere along the length of the elongate strap body. With conventional cable ties, there is a defined "head" that must be used.

Figure 2:
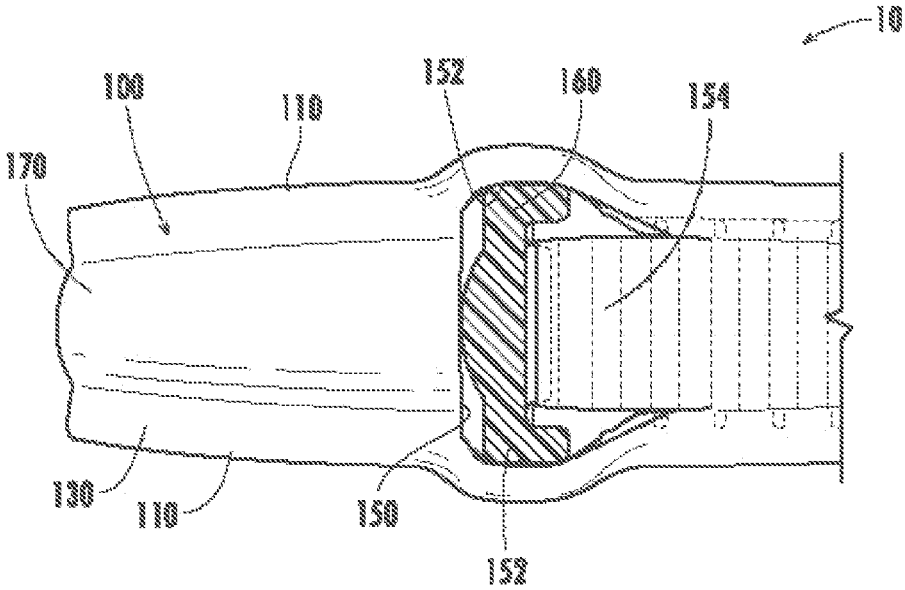
FIG. 2 is a top elevational view of the fastening system of FIG. 1 cut along the line 2-2, showing an end portion of an elongate strap body situated therethrough a slit formed in a portion of the elongate strap body.

In one aspect, and as illustrated in FIG. 2, the side portions adjacent the slit 150 deform outwardly away from the top surface as the end portion 160 of the elongate strap body is positioned therethrough the slit. In this way, the end portion of the elongate strap body 100 can be positioned through the slit without substantial rotational movement. In another aspect, at least one of the side portions on the end portion of the elongate strap body that is positioned therethrough the slit is foldable inwardly toward the longitudinal axis. In this aspect, the side portions 110 need not, necessarily, deform outwardly away from the top surface of the strap body in order to alleviate the need to rotate the end portion of the strap body when positioning it through the slit 150 and allowing the end portion 160 of the strap body 100 and the portion of the strap body containing the slit to be in substantially linearly intersecting planes.

Figure 6:
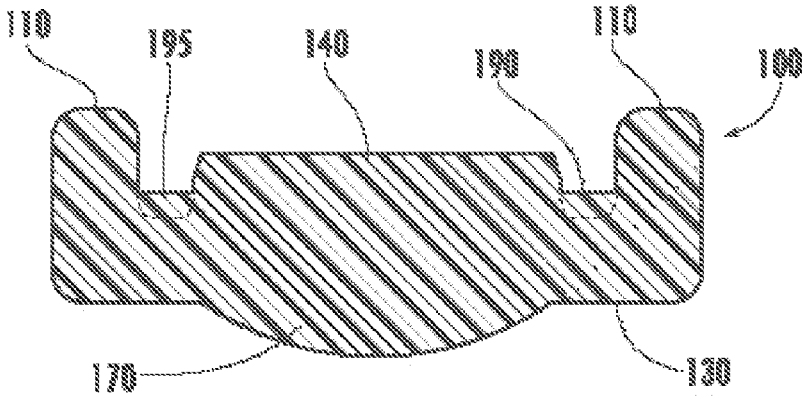
FIG. 6 is a front cut away view of a portion of the elongate strap body of the fastening system of FIG. 4, cut along line 6-6.

The elongate strap body may also comprise a longitudinally extending reinforcement member 170 attached to its bottom surface 130. This reinforcement member 170 provides additional support for the elongate strap body. In one aspect, as shown in FIG. 6, the reinforcement member substantially underlies the plurality of male protrusions. In another aspect, the cross-sectional width of the reinforcement member is substantially equal to the cross-sectional width of the overlying male protrusions.

In a further aspect, the elongate strap body 100 may also comprise a pair of elongate grooves 180 extending along its longitudinal length therebetween the plurality of male protrusions and each respective side portion. In this aspect, the end segments 152 of the slit formed therein the top surface 120 of the strap body can be formed therein each respective elongate groove.

Figure 3:
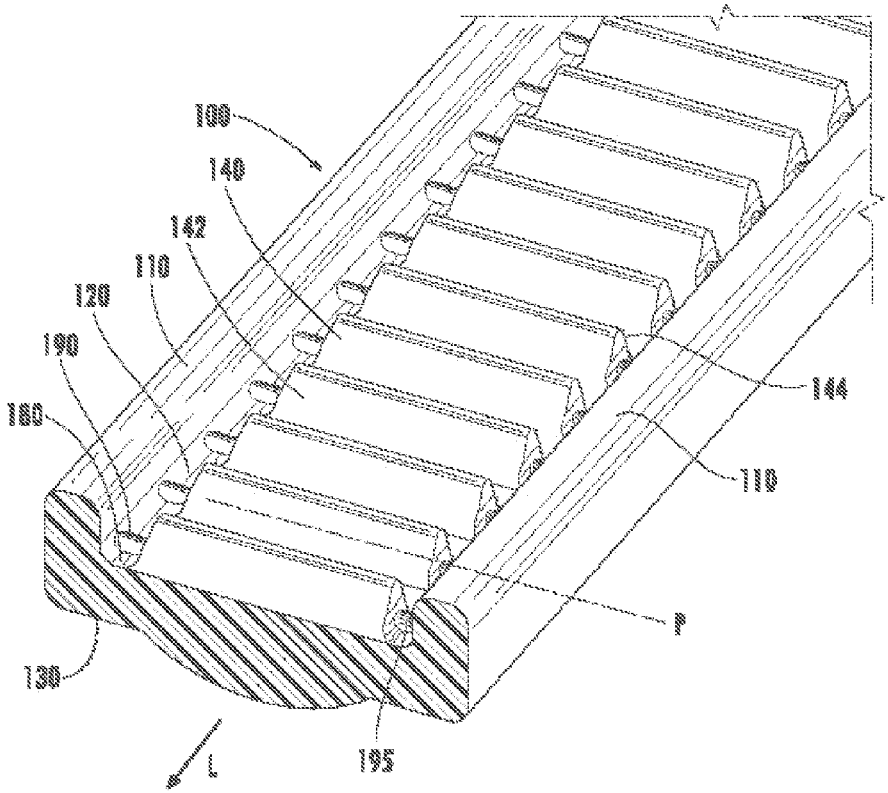
FIG. 3 is a perspective view of the elongate strap body of the fastening system of FIG. 1.
Figure 4:
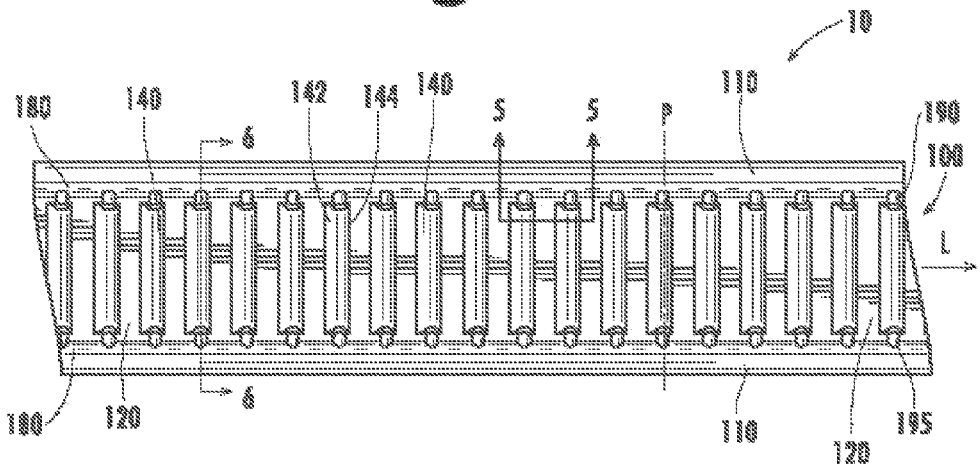
FIG. 4 is a top elevational view of the elongate strap body of the fastening system of FIG. 1, showing a plurality of male protrusions extending therefrom the top face of the elongate strap body.
Figure 5:
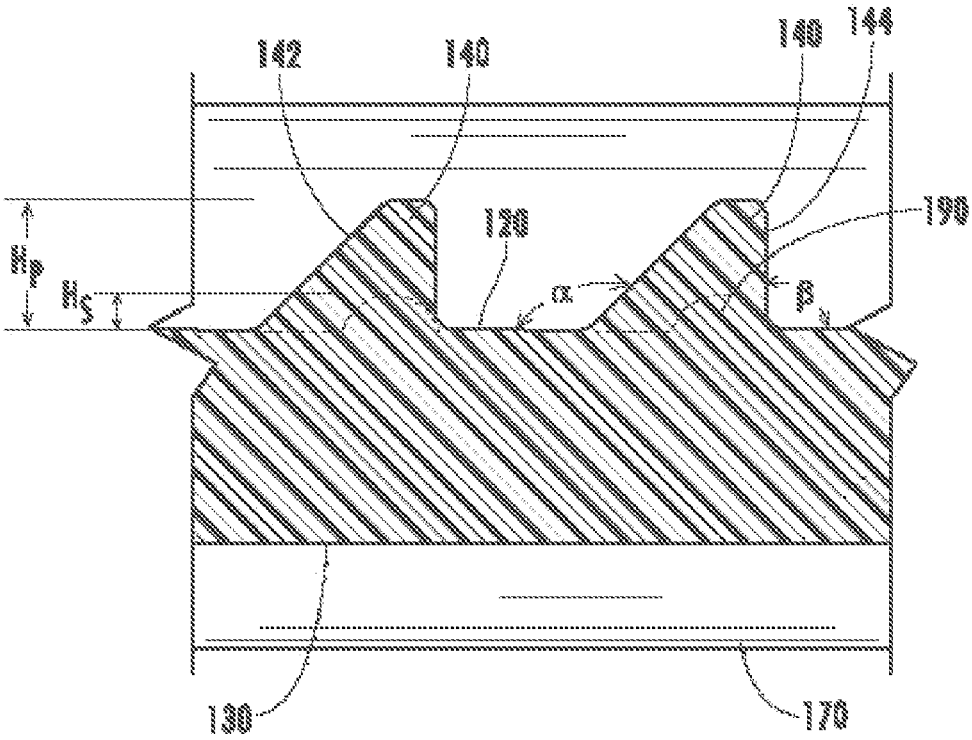
FIG. 5 is a side cut away view of a portion of the elongate strap body of the fastening system of FIG. 4, cut along line 5-5.

In one aspect, the fastening system 10 may also comprise a first shoulder 190 and a second shoulder 195, as shown in FIG. 3. Each shoulder extends therefrom the top surface 120 a shoulder height $H_S$, which is less than the protrusion height $H_P$ of the male protrusions 140. In this aspect, each shoulder extends therebetween an end of the male protrusion and each respective side portion. The shoulders provide additional support and can act as a stopping element. In this aspect, when a slit is formed, the end segments of the slit do not propagate too far down the longitudinal direction of the elongate strap body but, rather, tend to terminate proximate a respective shoulder 190, 195. In exemplary aspects, each shoulder may be integral with its adjacent side portion, as illustrated in FIG. 3, or it may be merely adjacent the side portion 110. Similarly, each shoulder may be integral with the adjacent male protrusion 140. In another aspect, the respective first and second shoulder is substantially collinear with the second face 144 of the respective adjacent male protrusion.

There are various ways by which to form the slit 150. Examples include, but are not limited to, using a knife or other sharp instrument, or using conventional punching tools or pressing tools. In another embodiment, a plurality of perforations may be formed through the body substantially in a desired area of the slit during or after the manufacturing process.

The fastening system of this invention may be manufactured in several ways. In one aspect, the manufacturing method comprises extruding a thermoplastic material into the desired shape. By using an extrusion method, the fastening system may be manufactured to almost any length. This way, the fastening system may be distributed in rolls, which would enable the end-user to cut the elongate strap body to practically any desired length. This advantage virtually eliminates the need to make several different sized strap bodies to accommodate various applications.

Although extruding the fastening system 10 has the advantage of flexibility, the fastening system may also be manufactured by injection molding a thermoplastic material into a desired shape, or by any other conventional method and/or process.

The preceding description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. The corresponding structures, materials, acts, and equivalents of all means or step plus function elements in the claims below are intended to include any structure, material, or acts for performing the functions in combination with other claimed elements as specifically claimed.

Accordingly, those who work in the art will recognize that many modifications and adaptations to the present invention are possible and can even be desirable in certain circumstances and are a part of the present invention. Other embodiments of the invention will be apparent to those skilled in the art from consideration of the specification and practice of the invention disclosed herein. Thus, the preceding description is provided as illustrative of the principles of the present invention and not in limitation thereof. It is intended that the specification and examples be considered as exemplary only, with a true scope and spirit of the invention being indicated by the following claims.

What is claimed is:

1. A fastener comprising:

an elongate strap body having a longitudinal axis and a pair of opposed side portions and a top surface therebetween the side portions;

a plurality of spaced male protrusions extending therefrom the top surface a protrusion height, each protrusion comprising a first face and an opposed second face and a protrusion axis, which is substantially perpendicular to the longitudinal axis of the strap body;

at least one slit generally extending therebetween the pair of side portions, substantially parallel to the protrusion axis, wherein the location is customizable and therebetween adjacent male protrusions, wherein the slit further comprises end segments extending substantially parallel to the longitudinal axis, such that a tongue is formed therein the elongate strap body; and a first shoulder and a second shoulder, wherein each shoulder extends therefrom the top surface a shoulder height, which is less than the protrusion height, and wherein each shoulder is therebetween the protrusion and each respective side portion;

wherein an end portion of the elongate strap body is positionable therethrough the slit to form a loop with the elongate strap body, and wherein, in use, constriction of the loop causes a portion of the tongue to slide thereon the respective first faces of the male protrusions on the end portion of the elongate strap body proximate the tongue and expansion of the loop is restricted by engaging a portion of the tongue thereon the second face of a protrusion on the end portion of the elongate strap body adjacent the tongue.

2. The fastener of claim 1, wherein the side portions adjacent the slit extend longitudinally and deform outwardly away from the top surface as the end portion of the elongate strap body is positioned therethrough the slit such that end portion of the elongate strap body can be positioned without substantial rotational movement.

3. The fastener of claim 1, wherein at least one of side portions on the end portion of the elongate strap body that is positioned therethrough the slit is foldable inwardly toward the longitudinal axis such that the end portion of the elongate strap body can be positioned without substantial rotational movement.

4. The fastener of claim 1, wherein expansion of the loop is restricted by engaging at least a portion of a second face of a protrusion thereon the tongue with at least a portion of the second face of a protrusion on the end portion of the elongate strap body adjacent the tongue.

5. The fastener of claim 1, further comprising a longitudinally extending reinforcement member attached to a bottom surface of the elongate strap body.

6. The fastener of claim 5, wherein the reinforcement member substantially underlies the plurality of male protrusions.

7. The fastener of claim 1, wherein the first face of the plurality of male protrusions extends therefrom the top surface at a predetermined first face angle.

8. The fastener of claim 7, wherein the predetermined first face angle is from about 120° to about 150°.

9. The fastener of claim 7, wherein the predetermined first face angle is about 125°.

10. The fastener of claim 1, wherein the second face of the plurality of male protrusions extends therefrom the top surface at a predetermined second face angle.

11. The fastener of claim 10, wherein the predetermined second face angle is from about 60° to about 120°.

12. The fastener of claim 10, wherein the predetermined second face angle is about 75°.

13. The fastener of claim 1, further comprising a pair of elongate grooves extending substantially along the longitudinal length of the elongate strap body therebetween the plurality of male protrusions and each respective side portion, whereby the end segments of the slit formed therein the top surface of the strap body are formed therein each respective elongate groove.

14. The fastener of claim 1, wherein the side portions extend upwardly above the top surface of the elongate strap body.

15. The fastener of claim 14, wherein the side portions extend above the top surface a distance that is greater than the protrusion height.

16. The fastener of claim 1, wherein a portion of the first shoulder is integral with the side portion adjacent the first shoulder and a portion of the second shoulder is integral with the side portion adjacent the second shoulder.

17. The fastener of claim 16, wherein a portion of the first shoulder and a portion of the second shoulder is integral with a portion of a respective adjacent male protrusion.

18. The fastener of claim 1, wherein the first and second shoulders are substantially collinear with the second face of the respective adjacent male protrusion.

19. The fastener of claim 1, wherein the means for forming a slit comprises a knife.

20. The fastener of claim 1, wherein the slit is formed by cutting means.

21. The fastener of claim 1, wherein the slit is formed by punching means.

22. The fastener of claim 1, wherein the slit is formed by pressing means.

23. The fastener of claim 1, wherein the means for forming a slit comprises a plurality of perforations formed therethrough the body substantially in a desired area of the slit.

24. The fastener of claim 1, wherein the male protrusions are substantially evenly spaced.

25. The fastener of claim 1, wherein the male protrusions are substantially evenly spaced over the length of the body.

26. The fastener of claim 1, wherein the protrusion height of each protrusion is substantially equal.

27. A method of manufacturing the fastener of claim 1, comprising extruding a thermoplastic material into a desired shape.

28. A method of manufacturing the fastener of claim 1, comprising injection molding a thermoplastic material into a desired shape.

29. A method of making a fastener, comprising:

providing an elongate strap body having a longitudinal axis and a pair of opposed side portions and a top surface therebetween the side portions;

forming a plurality of spaced male protrusions extending therefrom the top surface a protrusion height, each protrusion comprising a first face and an opposed second face and a protrusion axis, which is substantially perpendicular to the longitudinal axis of the strap body; and forming a first shoulder and a second shoulder, wherein each shoulder extends therefrom the top surface a shoulder height, which is less than the protrusion height, and wherein each shoulder is therebetween the protrusion and each respective side portion; and forming at least one slit therethrough a selected portion of the top surface of the strap body, the slit generally extending therebetween the pair of side portions, substantially parallel to the protrusion axis and therebetween adjacent male protrusions, wherein the slit further comprises end segments extending substantially parallel to the longitudinal axis, such that a tongue is formed therein the elongate strap body;

positioning an end portion of the elongate strap body therethrough the slit to form a loop with the elongate strap body, wherein, constriction of the loop causes a portion of the tongue to slide thereon the respective first faces of the male protrusions on the end portion of the elongate strap body proximate the tongue and expansion of the loop is restricted by engaging a portion of the tongue thereon the second face of a protrusion on the end portion of the elongate strap body adjacent the tongue.

30. A fastener comprising:

an elongate strap body having a longitudinal axis and a pair of opposed side portions and a top surface therebetween the side portions;

a plurality of spaced male protrusions extending therefrom the top surface a protrusion height, each protrusion comprising a first face and an opposed second face and a protrusion axis, which is substantially perpendicular to the longitudinal axis of the strap body;

a first shoulder and a second shoulder extending therefrom the top surface a shoulder height, which is less than the protrusion height, and wherein each shoulder is therebetween the protrusion and each respective side portion;

at least one slit generally extending therebetween the pair of side portions, substantially parallel to the protrusion axis, wherein the location is customizable and therebetween adjacent male protrusions, wherein the slit further comprises end segments extending substantially parallel to the longitudinal axis, such that a tongue is formed therein the elongate strap body; and a pair of elongate grooves extending substantially along the longitudinal length of the elongate strap body therebetween the plurality of male protrusions and each respective side portion, whereby the end segments of the slit formed therein the top surface of the strap body are formed therein each respective elongate groove.

31. A fastener comprising:

an elongate strap body having a longitudinal axis and a pair of opposed side portions and a top surface therebetween the side portions, wherein the side portions extend upwardly above the top surface of the elongate strap body;

a plurality of spaced male protrusions extending therefrom the top surface a protrusion height, each protrusion comprising a first face and an opposed second face and a protrusion axis, which is substantially perpendicular to the longitudinal axis of the strap body;

a first shoulder and a second shoulder extending therefrom the top surface a shoulder height, which is less than the protrusion height, and wherein each shoulder is therebetween the protrusion and each respective side portion; and at least one slit generally extending therebetween the pair of side portions, substantially parallel to the protrusion axis, wherein the location is customizable and therebetween adjacent male protrusions.

32. A fastener comprising:

an elongate strap body having a longitudinal axis and a pair of opposed side portions and a top surface therebetween the side portions;

a plurality of spaced male protrusions extending therefrom the top surface a protrusion height, each protrusion comprising a first face and an opposed second face and a protrusion axis, which is substantially perpendicular to the longitudinal axis of the strap body;

a first shoulder and a second shoulder extending therefrom the top surface a shoulder height, which is less than the protrusion height, and wherein each shoulder is therebetween the protrusion and each respective side portion; and at least one slit generally extending therebetween the pair of side portions, substantially parallel to the protrusion axis, wherein the location is customizable and therebetween adjacent male protrusions, wherein the means for cutting a slit comprises a plurality of perforations formed therethrough the body substantially in a desired area of the slit.

* * * * *